United States Patent [19]

Eckels

[11] 3,982,486

[45] Sept. 28, 1976

[54] NON-EXPENDABLE POSITIONING FRAME FOR MULTIPLE EXPLOSIVE CHARGES

[76] Inventor: Robert E. Eckels, 2101 Youngfield, Golden, Colo. 80401

[22] Filed: Jan. 14, 1975

[21] Appl. No.: 540,952

[52] U.S. Cl. ..... 102/24 HC

[51] Int. Cl.[2] ..... F42B 3/02

[58] Field of Search ..... 102/20, 22, 23, 24 HC

[56] References Cited

UNITED STATES PATENTS

| | | | |
|---|---|---|---|
| 2,898,085 | 8/1959 | Borins et al. | 102/24 HC |
| 3,348,482 | 10/1967 | Keener et al. | 102/24 HC |
| 3,741,119 | 2/1971 | Eckels | 102/24 HC |

*Primary Examiner*—Verlin R. Pendegrass

[57] ABSTRACT

An open framework having a plurality of positions for suspending a plurality of explosive charges in a predetermined pattern includes releasable grapple means for supporting an explosive charge at each position, means for suspending the framework and carried charges generally horizontally from an overhead support, and means for releasing the framework from the charges placed on target.

10 Claims, 11 Drawing Figures

NON-EXPENDABLE POSITIONING FRAME FOR MULTIPLE EXPLOSIVE CHARGES

It is widely known to position a plurality of explosive charges for producing certain results in a target area. It is, also, known to mount such charges in a frame and then place the frame with its carried array, so that all of the charges in their predetermined spacial arrangement are conjointly set on the target area. Such an arrangement is particularly useful for remotely placing an array of charges, in a predetermined spacing, where it is extremely difficult to place the individual charges in their proper position of predetermined spacing on the target. In my U.S. Pat. No. 3,741,119, there is described a modular rack, holding a plurality of explosive charges, which may be suspended by at least one overhead cable for placing the spacial array of charges on the detonation target. The framework of the patent is expendable, as it supports the charges through the detonation. A substantial amount of expense is involved in the construction of these one time use racks, which not only require adequate strength to carry the weight of the charges and the weighting material (when used under water) as well as to maintain the important alignment and spacing of the charges. These frames in and of themselves are quite heavy, and this requires additional strength to be built into them so that they may be suspended from an overhead cable. In order to reduce the cost of such frames, they are built from the least expensive materials available, which are usually not the strongest and, therefore, additional material must be used in building such frames.

In the above identified U.S. patent, there are described some major uses for such arrays of charges in predetermined spacial positioning. These uses include explosively forming ditches or trenches under water, where an array of pre-spaced charges is suspended from a ship's crane and lowered to the bottom. The array may be accurately placed on target; forming ditches or trenches in inaccessible ground areas where an array of plural spaced charges is suspended from a helicopter and lowered to ground position; placing an array of spaced shaped charges under water for reducing an underwater obstruction; etc.

According to the present invention, there is provided a non-expendable frame for supporting explosive charges in a predetermined spacial array during placement of the charges and after releasing the charges the array is spacially maintained in position on the target. Then the frame is retrieved before the detonation of the charges. The frame is arranged to be suspended from an overhead cable, moved to position and then the charges released when placed on the target in their predetermined position. The invention is highly useful for shaped charges but may be used for other types of explosive charges.

It is, therefore, an object and advantage of the invention to provide a non-expendable frame for spacing a series of explosive charges in a predetermined pattern on a target.

A further object of the invention is to provide a non-expendable frame for supporting a plurality of explosive charges in a predetermined pattern for placing the charges in the predetermined pattern on a target and releasing the explosive from the carrying frame while maintaining the predetermined pattern.

Another object of the invention is to provide a non-expendable frame for releasing a series of explosive charges in a predetermined pattern on a target in a remote placing.

Yet another object of the invention is to provide a non-expendable frame for the remote placing of a predetermined array of explosive charges, in a predetermined pattern, on a target free of the placing frame.

An additional object of the invention is to provide a non-expendable frame which may be re-used for the positioning of the frame-free plurality of explosive charges in a predetermined pattern on a target.

A further object of the invention is to provide a non-expendable frame for the remote and conjoint placement of all of the explosive charges of a predetermined pattern array on a target, and means for releasing the frame for retrieval of the frame prior to detonation of the charges.

These and other objects and advantages of the invention may be readily ascertained by referring to the following description and appended illustrations in which.

Figure 1:
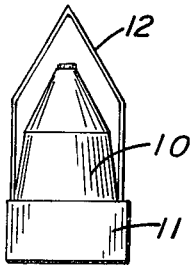
FIG. 1 is a side elevational view of one form of shaped charge useful for the invention.
Figure 2:
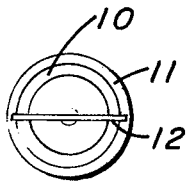
FIG. 2 is a top plan view of the device of FIG. 1.
Figure 3:
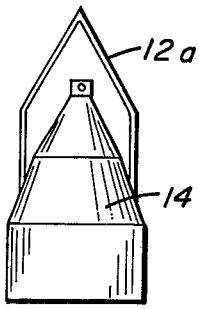
FIG. 3 is a side elevational view of a modified form of explosive charge useful for the invention.
Figure 4:
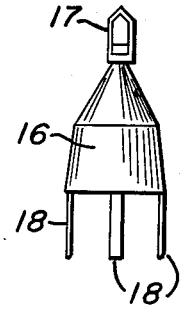
FIG. 4 is a side elevational view of a still further modified form of explosive shaped charge useful for open air detonation.

One form of explosive assembly useful for the invention is illustrated in FIG. 1, wherein a container 10 (usually metal, plastic or the like) for explosives is embedded in a circular concrete weight 11, into which a harness 12 is embedded. This permits the explosive to be suspended from a release hook or the like. The container 10 may be provided with an indented, shaped bottom to provide a shaped charge for the underwater detonation. A slightly modified form is shown in FIG. 3, wherein a concrete container 14 is provided with a harness 12*a* embedded in the concrete. The concrete container 14 is, of course, hollow and it may, also, be provided with a shaped indented base for producing a jet on detonation of the explosive contained in the container. In both of these cases the charge is provided as an individual and is arranged to be transported and released on target as a separate, individual charge. These weighted charges are generally preferred for underwater detonation since the concrete provides weighting material for holding the explosive container in position on the target and may provide the desired stand-off for the explosive device. A modified form for use in an air environment is illustrated in FIG. 4, wherein a shaped charge container 16 is provided with an upper harness support 17, permitting the explosive charge to be carried by a hook. A series of support legs 18 supports the explosive charge above the ground to provide an air stand-off for a shaped charge. Of course, the container 16 for a shaped charge must contain an indented bottom configuration to produce the high velocity jet of a shaped charge.

The shown containers are for liquid and semi-liquid explosives, and must, therefore, be leak-proof. However, a solid explosive may be formed in the necessary shape (similar to the containers) and when provided with a harness may be suspended in spacial arrays, as explained below.

Figure 5:
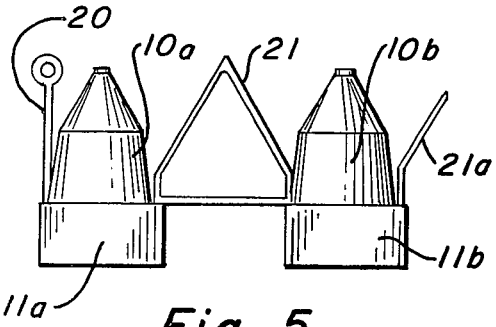
FIG. 5 is a side elevational view of a portion of a series of interconnected shaped charges for a modification of the invention.
Figure 6:
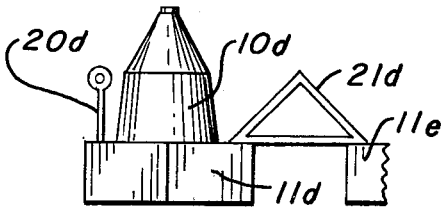
FIG. 6 is a modified form of a portion of a series of shaped charges in an array.

The explosive charges may be interconnected for maintaining the integrity of the pattern of the charges at target, and FIG. 5 illustrates one form of interconnecting individual, concrete base charges for underwater detonation. This includes a shaped charge container 10*a* embedded in a base 11*a* (in the general configuration of FIG. 1), and, also, imbedded with the container 10*a* is a carrying harness 20 arranged to support the array on a retrievable frame. A spacing bridge 21 is embedded in block 11*a* and in a concrete block 11*b* along with a container 10*b*. Also, embedded in the concrete block 11*b* is another spacing bridge 21*a* which is connected to additional adjacent blocks for spacing the individual explosive containers. The charges may be connected cross-wise and lengthwise of the array to provide integrity of the pattern after it is placed on target and the carrying frame is released from the array. This, also, provides means for some nominal displacement of the charges in relation to the contour of the target to permit the array to follow the contour of the target. This provides variable depth breaking of the target material by the explosives. A slightly modified form for the connection of explosives shown in FIG. 6, wherein a metallic shaped charge container 10*d* is embedded in a concrete block 11*d* and a carrying hook or harness 20*d* is embedded along with the container 10*d*. Spacing bridge 21*d* is, also, embedded in block 11*d*. Spacing bridge 21*d* is used to space block 11*d* from block 11*e*, its neighbor, in the manner explained for FIG. 5. The difference in this case is that block 11*d* is rectangular rather than circular as are the blocks 11*a* and 11*b* of FIG. 5. The purpose is, however, the same in that the bridge 21 provides spacing means for adjacent containers.

Figure 7:
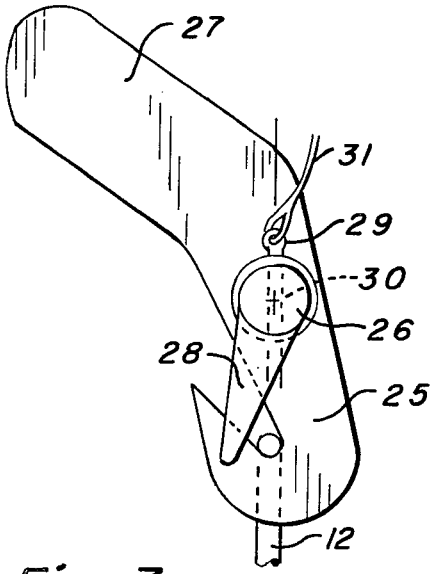
FIG. 7 is an enlarged view of one form of a gravity release hook for releasably suspending an explosive charge on the frame according to the invention, shown in its supported position.
Figure 8:
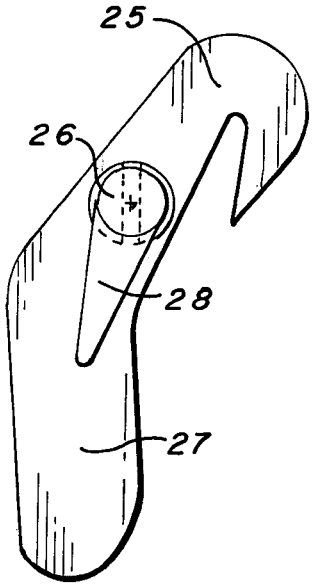
FIG. 8 is a side elevational view of the hook of FIG. 7 in its unloaded condition.

The individual containers for explosive material are arranged to be suspended by the harness or a hook from a retrievable frame. It is desirable to provide releasable hooks or grapples so that the explosives may be placed on target, in proper position, and then released from the retrievable frame, both remotely and with little effort. One form of gravity release hook is shown in FIGS. 7 and 8, wherein a hook 25 is pivotally mounted on a pin 26. Extending from the pin 26 is an angled, weighted portion 27 integrally attached to the hook 25. The weighted hook is arranged to support an explosive charge by means of harness 12, for example, and the hook will remain in the carrying position of FIG. 7 as long as the weight of the explosive charge is on the hook. This weight holds the hook in its carrying position. To insure that the hook will not accidentally be released from the harness 12 a locking finger 28 is attached to the pin 26, and it is maintained in a down position. The finger is non-rotatable on the stationary pin. The finger 28 covers the bite of the hook in its carrying position and prevents exit of the harness 12. In addition, a locking pin 29 passing through an aperture 30 in a boss of the hook 25 rotatable around the pin 26 prevents movement of the hook 25 rotating about the pin 26. A lanyard 31 attached to the pin 29 is arranged to remove the pin after the charge has been placed and the frame lowered far enough to release the weight from the hook. On removal of the pin, the hook pivots to the position of FIG. 8 releasing the explosive charges. Obviously, other types of releasable hooks may be used, and the hook described is satisfactory for many uses, being simple and of positive action.

As explained in my previous patent, identified above, a plurality of charges are spacially positioned in an array, exactly spaced from their neighbors according to the material of the target, the desired breakage of the target is achieved by the optimum spacing between the individual explosive charges. As pointed out in the patent, a plurality of rows of explosive charges are sequentially detonated, with all of the charges in each row detonated simultaneously, so that there is a timed relation of the detonation of the individual rows from the first to the last rows to achieve maximum breakage of the target material.

Figure 9:
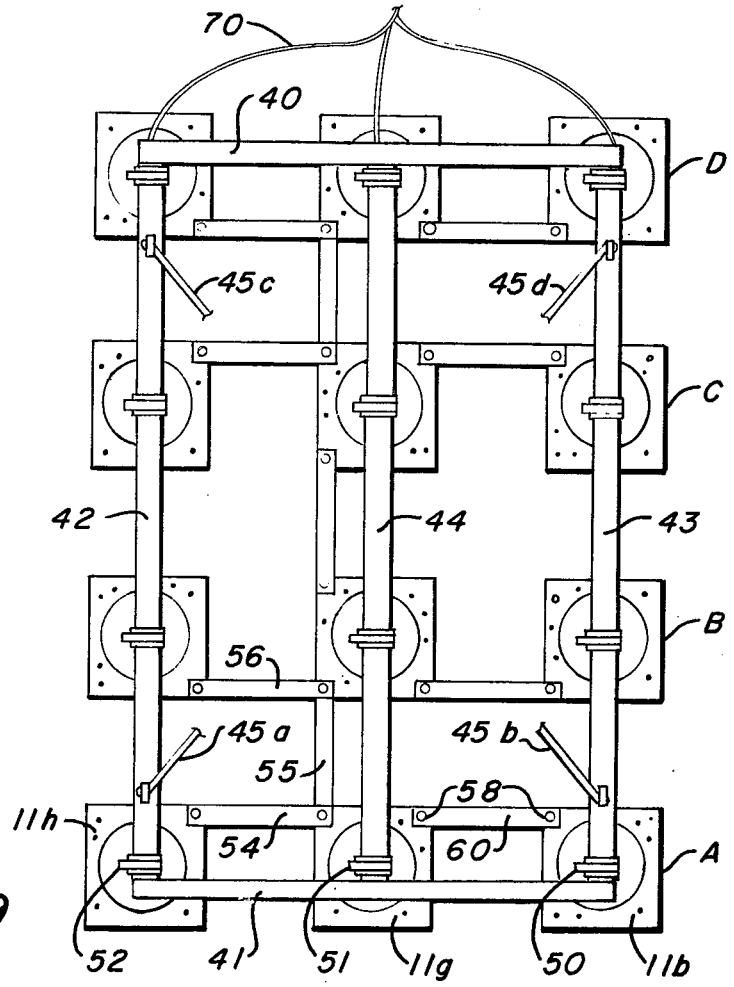
FIG. 9 is a top plan view of one form of retrievable frame for supporting a plurality of explosive charges in a predetermined pattern, according to the invention.
Figure 10:
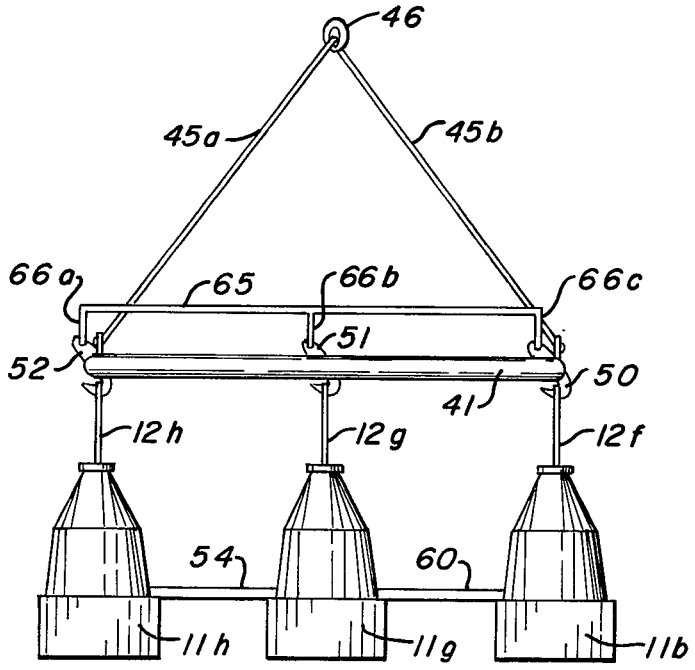
FIG. 10 is an end elevation of the device of FIG. 9.

The array of individual charges may be suspended from a retrievable frame, shown in FIGS. 9 and 10, which includes suspending ropes or a harness from the corners of an open frame. Releasable hooks at predetermined spacings on the open frame hold the individual explosive charges. The retrievable frame shown in FIGS. 9 and 10, includes a peripheral frame, having end members 40 and 41 connected together by peripheral side members 42 and 43. The frame, also, includes a central longitudinal member 44. The members of the open frame may be formed of steel or similar tubes to provide a strong open framework for supporting the suspended explosive charges. The open framework is arranged to be suspended from a single haul rope, not shown, connected to harness ropes 45*a*, *b*, *c*, and *d*, secured to the peripheral framework, adjacent the corners, and meeting at a central point where it is connected to a single haul rope 46 shown in FIG. 10. The harness ropes 45 may be connected to the peripheral frame by any convenient means to support the weight of the explosive charges and the retrievable frame.

Mounted on the open frame members at predetermined positions are a series of releasable hooks, such as described in FIGS. 7 and 8, and an explosive charge is releasably mounted on each of the hooks. For example, an explosive charge 11*b* is secured to a releasable hook 50 mounted adjacent the lower right corner of the frame of FIG. 9. An explosive charge 11*g* is secured to a releasable hook 51 mounted on the center member 44, adjacent the end member 41, and in a similar manner an explosive charge 11*h* is releasably secured to a releasable hook 52 mounted adjacent the lower left corner of the frame. Similarly, a series of explosives are individually connected to a hook, with the hooks being secured to the frame in the desired spacing relationship. For maintaining the general integrity of the configuration or pattern of the explosive members, several spacing straps, such as 54, 55 and 56, may be secured to pins 58, embedded in the corner of the concrete portion of the charges. The arrangement of these three straps space four adjacent explosives in a spaced apart relation. A strap 60 secured to pins 58 in the corner of blocks 11*f* and 11*g*, provides spacing of the third member of the first row of explosives 11*f*, *g* and *h*. In a similar manner, simple straps attached to pins 58 embedded in the blocks provide means for spacing the individual explosive charges. Each of the explosive charges includes a hanger which may be attached to the container or to the concrete block, and in case of FIG. 10, the hangers are attached to the container itself. In either case, the hanger is a bail type hanger.

The explosives of each row are mounted on their respective hooks by the bails, and the hooks are maintained in carrying position by means of a connecting rod 65 (FIG. 10) which is attached by drops to each of the hooks. The hooks are thereby maintained in a carrying position as long as the connecting rod is pulled into its uppermost position. For example, the connecting rod 65 has drop 66*a* to the hook 52, has drop 66*b* to a hook 51, and a drop 66*c* to hook 50. Each row of hooks are provided with a similar overhead lock means as shown in FIG. 10, and so row A has its overhead lock means, row B, row C and row D, likewise, have their overhead lock means. The lock means may be connected together so that after the charges are placed on target, that is, resting on the surface of the target, all the releases may be concurrently actuated to release the hooks from the bails of the individual charges. This places the charges in spaced relation on the target. Once the hooks are released from the charge, the frame may be retrieved by pulling up the haul rope and returning the frame to the barge, ship or the like. The explosive charges remain on target, and are secured together by means of a detonating cord or the like, for example, the harness shown as numeral 70 extending from a single lead and then extended from row to the succeeding rows, as, for example, from row D to row C to row B and to row A, as set forth in my earlier patent above identified. With the framework retrieved from the area, the detonation may then be initiated.

Figure 11:
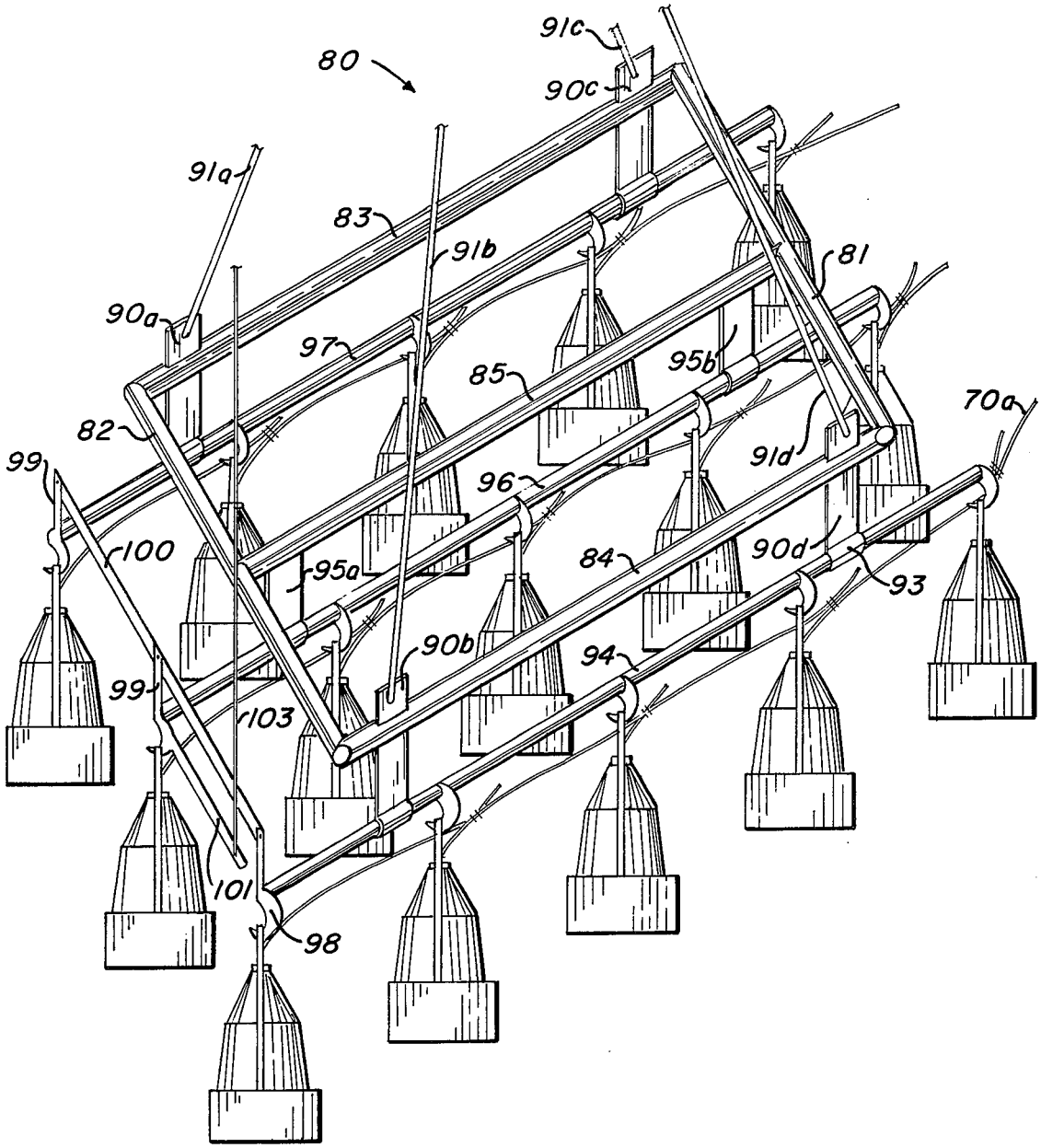
FIG. 11 is a perspective view of a modified form of frame for supporting a plurality of charges in a predetermined spacial arrangement and for releasing such charges in their spacial arrangement on a target.

A modified retrievable frame is illustrated in FIG. 11, wherein a peripheral framework such as shown in FIG. 9 suspends an integral hook and release mechanism for supporting each of a series of individual explosives. In this case, the frame 80 includes end members 81 and 82 with joined side members 83 and 84 along with a middle member 85, which may all be integrally secured together by welding or otherwise. A drop frame member is provided adjacent each corner of the rectangular frame, and this includes drop members 90*a*, 90*b*, 90*c* and 90*d* adjacent each of the corners. These drops provide means for attachment of the harness lines 91, including lines 91*a*, 91*b*, 91*c* and 91*d*, respectively, mounted on the adjacent drop. Each drop is provided with a passage at its lower end supporting a rotatable elongated rod member, which in turn has a series of hooks supporting the individual charges. For example, the drop member 90*b* includes a sleeve or passage 93 through which is passed a rod 94 arranged for rotation in the sleeve 93. In a similar manner, each of the other drops are provided with sleeves rotatably mounting a rod having the attached hooks. The frame member 85 is, also, provided with a drop 95*a* at one end, a drop 95*b* at the opposite end, and these two, likewise, are provided with sleeves through which another hook supporting rod 96 is rotatably mounted, in a similar manner the drops 90*a* and 90*c* rotatably support a rod 97. The rods 94, 96 and 97 are provided with a series of spaced hooks 98 which are integral with the rod and rotatable on which it is mounted. The hooks 98 are arranged to support the bails of the explosive charges when in their up rotated position, and to release the charges when rotated in the down or opposite direction. To provide rotation of the rods 94, 96 and 97, an extension 99 is mounted on the hooks at the one end of the rods, in this case, the left end, and these extensions are pivotally connected together by means of a connecting rod 100 so that rotation of one rod will equally rotate the other two rods, or the number of rods for the particular frame. To rotate the rods, the center hook member 98 is provided with an integral extension 101 (which may be attached to the rod) to which is attached a release line or lanyard 103. With this particular frame, the weights may be secured to the hooks by having the hooks with their points in an upward position. The hooks will then support the explosive array suspended from the frame 80 until the rods are turned to point the hook points in downward position, and, thereby, release the individual explosive charges. The detonating means for the individual charges includes a primer cord harness 70*a* which is arranged to sequentially explode each line or row of explosives from the entrance point of the harness to the explosive array to the final row.

The frames are preferably made of as light material as is necessary to support the weight. Generally pipe or tube-like members may be welded together for supporting the weight of the charge array. Obviously the frames must be made of a sufficient size to support the number of charges desired for a particular array. While the frames shown are arranged for three explosives in a row, the rows may be made for any number of explosives necessary. Also, the number of rows may be determined by the lifting equipment available and/or the need at the particular target. As shown one frame supports four rows and another frame supports five. As shown in FIG. 11, alignment spacers may be used between the charges if desired or deemed necessary, and as shown in FIG. 9 the spacers may be deleted if they are not found necessary.

In using the device of the invention, for example, where a crane on a barge is used to lower the explosive array onto an underwater target, the frame may be placed above charges and the bails of the charges placed on the spaced hooks. When all of the charges are attached to the hooks, the detonating train is attached to the charges. The barge crane may then lift the frame up and over the side, and then lower the array onto the target area. Once the charges are resting on the target surface, the frame may be released and retrieved by hauling back on the haul line. The retrievable frame is thus ready for immediate use for another array of charges.

As pointed out above, the charges with the concrete weights are useful for underwater detonation, however, where the arrays are to be placed by helicopter, the concrete weight is not necessary and the configuration such as shown in FIG. 4 may be used for the array mounted on a frame and positioned by a helicopter. A lighter frame may suffice for such aerial placement.

The spacing members which may be optionally used on the individual charges may be of wood, metal, wire, strap, etc. and they may be needed in uneven topography simply to provide the necessary spacing of the charges. It is further, obvious that the gravity release hooks may be placed or joined with mechanical, hydraulic pneumatic, or electric releasing mechanisms, where the application of the same may be suitable in air or under water.

What is claimed is:

1. Non-expendable frame apparatus for the remote, simultaneous placing of a plurality of explosive charges at predetermined space intervals, comprising:

a. open frame means of sufficient strength to support a plurality of individual, separate explosive charges laterally spaced from each other and suspended therefrom;

b. means for suspending said open frame means in a generally horizontal position from at least one overhead haul rope;

c. releasable holding means depending downwardly from said open frame means at predetermined spacing for individually holding each one of a plurality of explosive charges; and d. release means interconnected with said releasable holding means for simultaneously releasing all of the explosive charges in their predetermined position.

2. Non-expendable frame apparatus according to claim 1 wherein said open frame is a peripheral frame.

3. Non-expendable frame apparatus according to claim 2 wherein said peripheral frame is formed of tubular members.

4. Non-expendable frame apparatus according to claim 1 wherein said means for suspending said frame means is a harness including spaced apart lines joined at a central location and all attached to said at least one haul rope.

5. Non-expendable frame apparatus according to claim 1 wherein each said releasable holding means includes hook means for holding a bail on each individual explosive charge.

6. Non-expendable frame apparatus according to claim 5 being further characterized by extending weight means depending from each hook means for the gravity turning of hook means to release position in the absence of charge weight on the hook means.

7. Non-expendable frame apparatus according to claim 5 wherein the release means includes lock means for each said hook means, and means interconnected together for the simultaneous release of said lock means.

8. Non-expendable frame apparatus according to claim 1 wherein said releasable holding means includes a series of rotatable parallel bars suspended below said open frame means, and hook means spacedly mounted on said bars hold said plurality of explosive charges.

9. Non-expendable frame apparatus according to claim 8 wherein lock and rotate means is interconnected with all said parallel bars whereby said bars may be simultaneously released and rotated to release said explosive charges.

10. Non-expendable frame apparatus according to claim 1 wherein said release means is controlled by a single lanyard for simultaneously releasing all said release means.

* * * * *